US009879529B2

(12) United States Patent
Scholz et al.

(10) Patent No.: US 9,879,529 B2
(45) Date of Patent: Jan. 30, 2018

(54) APPARATUS FOR GENERATING PULSES IN FLUID DURING DRILLING OF WELLBORES

(71) Applicants: Eckard Scholz, Eldingen (DE); Thomas Kruspe, Wietzendorf (DE)

(72) Inventors: Eckard Scholz, Eldingen (DE); Thomas Kruspe, Wietzendorf (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 252 days.

(21) Appl. No.: 14/714,442

(22) Filed: May 18, 2015

(65) Prior Publication Data

US 2016/0341001 A1 Nov. 24, 2016

(51) Int. Cl.
*E21B 34/06* (2006.01)
*E21B 47/18* (2012.01)

(52) U.S. Cl.
CPC ..... *E21B 47/187* (2013.01); *E21B 47/185* (2013.01)

(58) Field of Classification Search
CPC ..... E21B 47/18; E21B 47/12; E21B 47/187; E21B 47/185
See application file for complete search history.

(56) References Cited

U.S. PATENT DOCUMENTS

2005/0145812 A1* 7/2005 Kumar ..... F16K 31/10 251/129.15
2005/0260089 A1* 11/2005 Hahn ..... E21B 47/182 417/505
2013/0342354 A1* 12/2013 Petrovic ..... G01V 11/002 340/854.6
2015/0123808 A1* 5/2015 Vick, Jr. ..... E21B 47/122 340/854.6

* cited by examiner

*Primary Examiner* — Giovanna C Wright
*Assistant Examiner* — Brandon Duck
(74) *Attorney, Agent, or Firm* — Cantor Colburn LLP

(57) ABSTRACT

In one aspect, an apparatus for use in a drilling assembly is disclosed that in one embodiment includes a flow control device that further includes: a fluid flow path having an inlet and an outlet; an electromagnetic circuit that includes a closing member made from a soft magnetic or magnetic material as a part of the electromagnetic circuit, wherein the closing member moves from a first open position to a second closed position to close the fluid flow path to produce a pressure pulse in a fluid flowing through the fluid flow path when the electromagnetic circuit is formed.

16 Claims, 4 Drawing Sheets

APPARATUS FOR GENERATING PULSES IN FLUID DURING DRILLING OF WELLBORES

BACKGROUND

1. Field of the Disclosure

This disclosure relates generally to drilling system that include a drilling assembly that include a mud pulse telemetry system in a drilling assembly for transmitting signals between downhole locations and a surface location during drilling of wellbores.

2. Background of the Art

Wells (also referred to as wellbores or boreholes) are formed in earth formations for the production of hydrocarbons (oil and gas). A drill string including a drilling assembly (also referred to as a bottomhole assembly or "BHA") attached to a drill pipe is conveyed into the wellbore for drilling a wellbore. A drill bit connected to the end of the drilling assembly is rotated by rotating the drill pipe and/or by a motor in the drilling assembly to form the wellbore. A fluid (referred to as "mud") is supplied under pressure into the drill string, which fluid discharges at the bottom of the drill bit and returns to the surface along with rock cuttings cut by the drill bit. The drill string commonly includes a number of sensors, including a pressure sensor, vibration sensor, temperature sensor, accelerometers, gyroscopes, etc. and also tools referred to a logging-while-drilling tools that may include resistivity, acoustic and nuclear sensors for proving information or characteristics of the formations through which the wellbore is being drilled. The data obtained from such sensors and tools is processed in the drilling assembly to obtain certain parameters and some such information is transmitted during drilling to a surface computer system for further processing and to control the drilling operation. Mud pulse telemetry in which a pulsing device (also referred to as a "pulser") generates pressure pulses in the fluid passing through the drilling assembly is commonly used to transmit signals from the drilling assembly to the surface. The data or information is transmitted as coded pressure pulses, which are decoded by the surface computer. During drilling, a typical mud pulser substantially continuously generates pressure pulses over long time periods, often several days. In addition, a number of wellbores are currently drilled in formations having temperatures above 300 degrees Fahrenheit. A majority of currently utilized mud pulsers include oil fillings, elastomers and/or electrical high pressure connectors, which tend to deteriorate over time and are not suitable for use in high temperature wells.

The disclosure herein provides pulsers that are suitable for high temperature use and also may be made without the use of oil fillings, elastomers or electrical high pressure connectors.

SUMMARY

In one aspect, an apparatus for use in a drilling assembly is disclosed that in one embodiment includes a flow control device that further includes: a fluid flow path having an inlet and an outlet; an electromagnetic circuit that includes a closing member made from a soft magnetic or magnetic material as a part of the electromagnetic circuit, wherein the closing member moves from a first open position to a second closed position to close the fluid flow path to produce a pressure pulse in a fluid flowing through the fluid flow path when the electromagnetic circuit is formed.

In another aspect, a method of producing pressure pulses in a wellbore during drilling of the wellbore is disclosed, which method in one embodiment includes: conveying a drilling assembly in the wellbore, the drilling assembly including a flow control device that further includes a fluid flow path having an inlet and an outlet, a coil between a first soft magnetic or magnetic member and a second soft magnetic or magnetic member and a closing member made from a soft magnetic or magnetic material, wherein when the coil is energized, an electromagnetic circuit is formed that moves the closing member from a first open position to a second closed position to close the fluid path to produce a pressure pulse in a fluid flowing through the fluid flow path.

Examples of the more important features of a certain apparatus and methods have been summarized rather broadly in order that the detailed description thereof that follows may be better understood, and in order that the contributions to the art may be appreciated. There are additional features that will be described hereinafter, which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
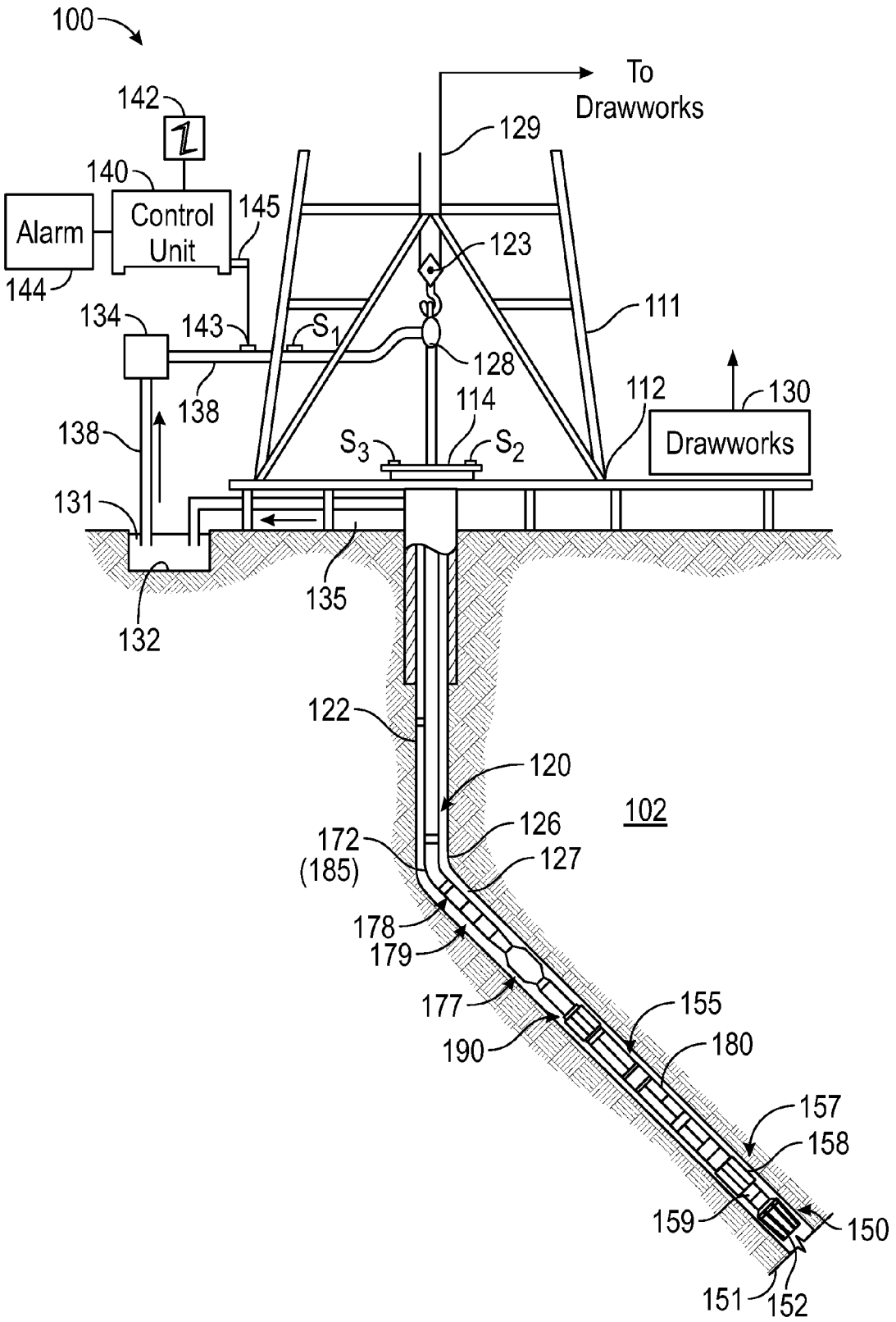
FIG. 1 shows a drilling system in which a drilling assembly is conveyed in a wellbore that includes a flow control device made according to an embodiment of the disclosure for generating pressure pulses corresponding to information to be telemetered to the surface.

FIG. 1 shows a schematic diagram of a drilling system 100 with a drill string 120 that includes a drilling assembly 190 (also referred to as the bottomhole assembly, or BHA) attached to a bottom end of a conveying member, such as a drill pipe or coiled tubing 122. The drill string 120 is shown conveyed into the wellbore 126 being formed in formation 102. The drilling system 100 is further shown to include a conventional derrick 111 erected on a floor 112 that supports a rotary table 114 that is rotated by a prime mover such as an electric motor (not shown) at a desired rotational speed. A top drive (not shown) may be used instead of a motor to rotate the rotary table. The drill string 120 is pushed into the wellbore 126 when a drill pipe 122 is used as the tubing. For coiled-tubing applications, a tubing injector (not shown) is used to move the tubing from a reel (not shown), to the wellbore 126. A drill bit 150 attached to the end of the drilling assembly 190 breaks up the geological formations when it is rotated to drill the borehole 126. If a drill pipe 122 is used, the drill string 120 is coupled to a draw works 130 via a swivel 128 and line 129 through a pulley 123. During drilling, the draw works 130 is operated to control the weight on bit to control the rate of penetration of the drill bit.

During drilling, a suitable drilling fluid 131 from a mud pit (source) 132 is pumped into the drill string 120 by a mud pump 134. The drilling fluid 131 passes from the mud pump 134 into the drill string 120 and discharges at the bottom 151 of the borehole 126 through openings 152 in the drill bit 150. The drilling fluid 131 circulates uphole through the annular space 127 (annulus) between the drill string 120 and the borehole 126 and returns to the mud pit 132 via a return line 135. The drilling fluid 131 lubricates the drill bit 150, carries the rock cutting made by drill bit 150 to the surface and maintains pressure in the wellbore 126 above the formation pressure along the wellbore 126 to prevent blow outs. A sensor $S_1$ placed in the line 138 provides information about the fluid flow rate. Surface sensors $S_2$ and $S_3$ associated with the drill string 120 respectively provide information about the torque and rotational speed of the drill string 120. Additional sensor (not shown) may be utilized to provide the hook load and other desired parameters relating to the drilling operations.

In one embodiment of the disclosure, the drill bit 150 is rotated by only rotating the drill pipe 122. In another embodiment of the disclosure, a downhole motor 155 (mud motor) disposed in the drilling assembly 190 rotates the drill bit 150. The drill pipe 122 may be rotated to supplement the rotational power of the mud motor 155 and to effect changes in the drilling direction. In the embodiment of FIG. 1, the mud motor 155 is coupled to the drill bit 150 via a shaft disposed in a bearing assembly 157. The mud 155 motor rotates the drill bit 150 when the drilling fluid 131 passes through the mud motor 155 under pressure. The bearing assembly 157 supports the radial and axial forces of the drill bit. A stabilizer 158 coupled to the bearing assembly 157 acts as a centralizer for the lowermost portion of the drilling assembly 190.

In one embodiment of the disclosure, a drilling sensor module 159 is placed near the drill bit 150. The drilling sensor module 159 contains sensors, circuitry and processing software and algorithms relating to the dynamic drilling parameters. Such parameters include, but are not limited to bit bounce, stick-slip, backward rotation, torque, shocks, borehole and annulus pressure, acceleration and other parameters of the drill bit and drilling assembly condition. The drilling assembly 190 further includes a number of logging-while-drilling (LWD) tools or sensors (collectively designated by numeral 180). The LWD tools may include a resistivity tool, an acoustic tool, an active source nuclear tool, a gamma ray tool, a formation testing tool to provide information about various parameters or characteristics of the formation 102. The various tools include processors and electronic circuitry that process information from their respective tools and provides information about the various parameters of interest to be transmitted to the surface. The drilling assembly 190 also includes electronic circuitry and processors that process signals from the sensors 159 and provide information of parameters to be transmitted to the surface. The drilling assembly 190 further includes a power unit 179 that generates power for use by the various devices in the drilling assembly and a telemetry unit 172 that includes a fluid control device or pulser 185 made according to one embodiment of the disclosure that generated pressure pulses corresponding to information desired to be sent to the surface. The operation of the pulser 185 is controlled by a processor associated with the telemetry unit 172.

The processor associated with the pulser 185 causes the pulser 185 to generate pressure pulses corresponding to the signals to be sent to the surface. Sensor 145 detects such pressure pulses and provides information relating thereto to a surface control unit 140. The system 140 may be a computer-based system that processes the received pulses and provides information to an operator to takes action or takes action by itself in accordance with programs provided to the control unit 140. The control unit 140 displays desired drilling parameters and other information on a display/monitor 142 utilized by an operator to control the drilling operations. The control unit 140 activates alarms 144 when certain unsafe or undesirable operating conditions occur. Certain embodiments of fluid control devices 185 for use in the system 100 are described below in reference to FIGS. 2-4.

Figure 2:
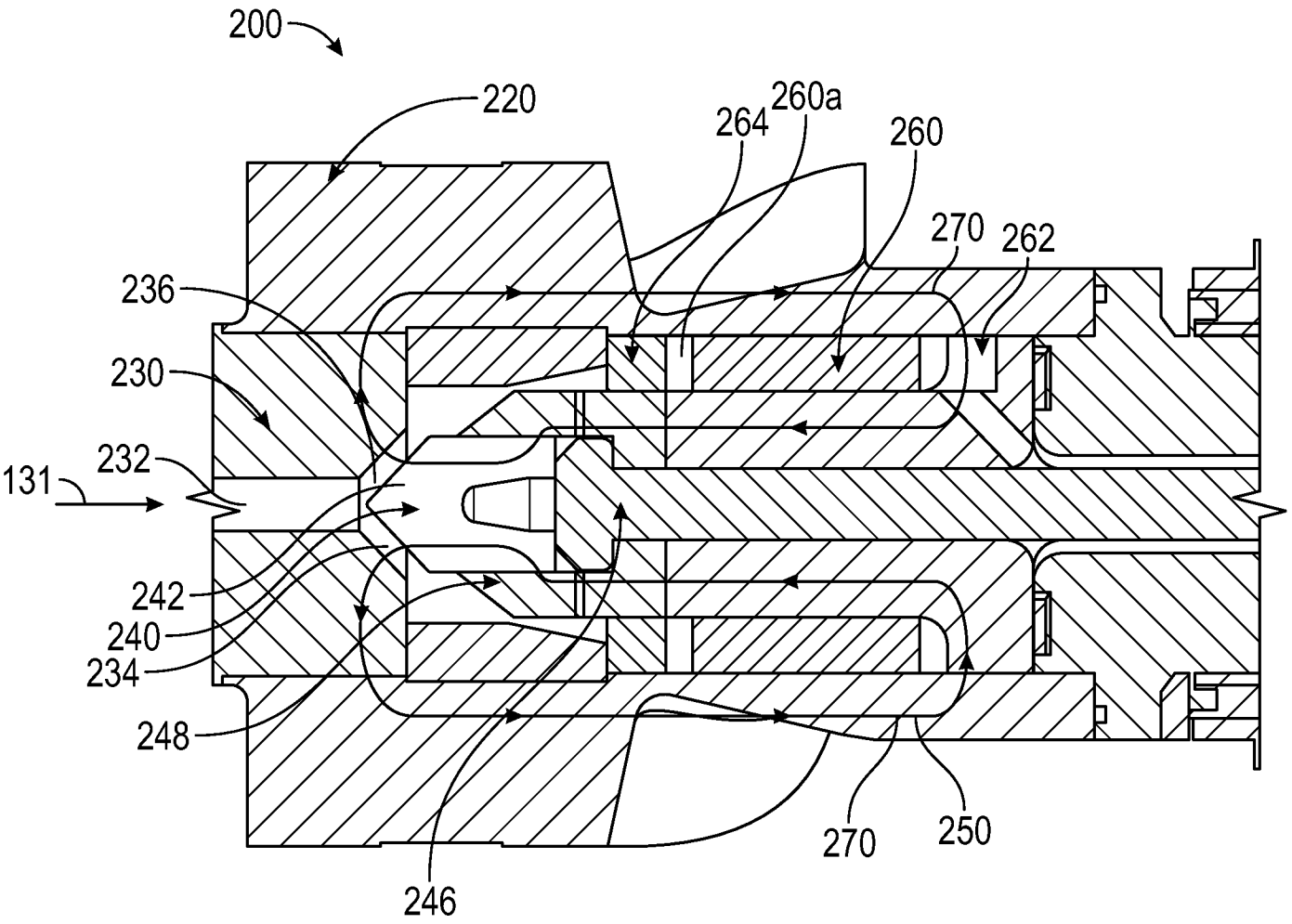
FIG. 2 shows a flow control device according an embodiment of the disclosure that may be utilized in a system, such as system shown in FIG. 1.

FIG. 2 shows a flow control device 200 in an open position made according to one embodiment of the disclosure that may be utilized in a drilling assembly, such as drilling assembly 190 of system 100 of FIG. 1 for performing a selected downhole function. The flow control device 200 may be incorporated into a hydraulically-controlled main valve and may act as a control valve. The flow control device 200 is also referred to herein as a valve or pulser. The device 200 includes an inlet guide 220 of a turbine (not shown) that houses a member 230 having a fluid flow through path or a passage 232 that terminates in an outlet 234. Fluid 131 supplied to the drilling assembly (190, FIG. 1) will flow through the flow through path 232 and discharge at an outlet 234. The outlet 234 terminates at a valve seat 236. The device 200 further includes a movable member, such as a plunger 240 having a face 242 that conforms to the shape of the seat 236 so that when the face 242 moves into or engages the seat 236, it blocks or substantially blocks the flow of the fluid 131 through the passage 232 to generate a positive pressure pulse in the fluid 131 in the drill string 120 (FIG. 1). The plunger 240 is linearly supported by a support member 246, which in one embodiment may be the head of a screw. The plunger 240 is radially supported by and moves linearly or axially inside a cylindrical support member 248 within the inlet guide 220. A member 250 made from a magnetic material surrounds the support member 246. For the purpose of this disclosure, the term magnet includes any suitable magnet, including a soft magnet and the phrase magnetic member or magnetic material includes any suitable magnetic member or material, including soft magnetic member or soft magnetic material. A coil 260 placed in a coil carrier 262 may be placed around the magnetic member 250 and inside the inlet guide 220. A non-magnetic cylindrical spacer or ring 264 around the support member 248 axially supports the coil carrier 262 at its front end 260*a*.

Referring to FIGS. 1 and 2, the inlet guide 220, member 250, cylindrical support member 248, plunger 240, inlet guide 230 are made from a suitable magnetic material, while the support ring 264 and the linear support member 246 are made from a suitable non-magnetic material. In the particular configuration of the device 200, when the coil 250 is excited (electrically powered), an electromagnetic circuit is formed from the magnetic material 250 to the inlet guide 220 via the support member 248, the plunger 240 and the inlet guide 220, as shown by arrows 270. The magnetic flux created by the circuit 270 causes the plunger 240 to move axially toward the valve seat 236, causing the face 242 to engage with the valve seat 236, blocking or substantially blocking the flow of the fluid 131 through the passage 232. Blocking the flow of the fluid 131 generates a pressure pulse in the fluid 131 flowing through the drill string 120. Removing the power from or de-energizing the coil 260 interrupts the magnetic circuit 270 and the pressure of the fluid 131 applies a force on the plunger 240, causing it to retract to the open position shown in FIG. 2, which opens the fluid passage 232, which in turn produces a negative pressure pulse in the fluid 131. Thus, each energizing of the coil 260 produces a positive pressure pulse and each de-energizing causes a negative pressure pulse. Thus, a positive pressure generated by the device 200 will provide a leading edge of a pulse (when the coil is energized) and a negative pressure will provide a trailing edge of a pulse (when the coil is de-energized). Alternatively, the negative pressure may be designated as the leading edge and the positive pressure as the trailing edge of a pulse. In either case a pressure pulse will include a leading edge and a trailing edge. In either case, the flow rate through the passage 232 defines the amplitude of the pulse, the duration between energizing and de-energizing of the coil 260 or vice versa defines the pulse width and the number of pulses in a selected time period defines the frequency of the pulses generated. In aspects, the flow control device 200 can operate in the main flow of a fluid, that is the entire flow of the fluid passes through the device 200 or it can operate in a bypass mode such that only a certain portion of the fluid passes through the device 200 or alternatively it can operate as a control valve of a larger hydraulically-actuated main valve that acts on the entire flow of the fluid.

The magnetic flux path or circuit 270 is formed each time the coil 250 is energized. The magnetic flux path 270 is formed from the core 256 to the support member 248, from the support member 248 to the plunger 240, from the plunger 240 to the inlet member 230 and from the inlet member 230 to the inlet guide 220. The non-magnetic spacer 264 prevents shorts in the circuit 270. In the embodiment of the flow control device 200, the coil 260 may be placed in a sealed and clean 1-bar environment. In the particular embodiment of the device 200 in FIG. 2, the plunger 240 is the only part of the device 200 that moves when the coil 260 is powered. The magnetic flux generated in the circuit 270 moves the plunger 240 in the direction of the valve seat 236. While pulsing, the plunger 240 slides in an environment that is flooded with fluid 131, which enables the plunger 240 to slide back and forth with relatively low friction.

Figure 3:
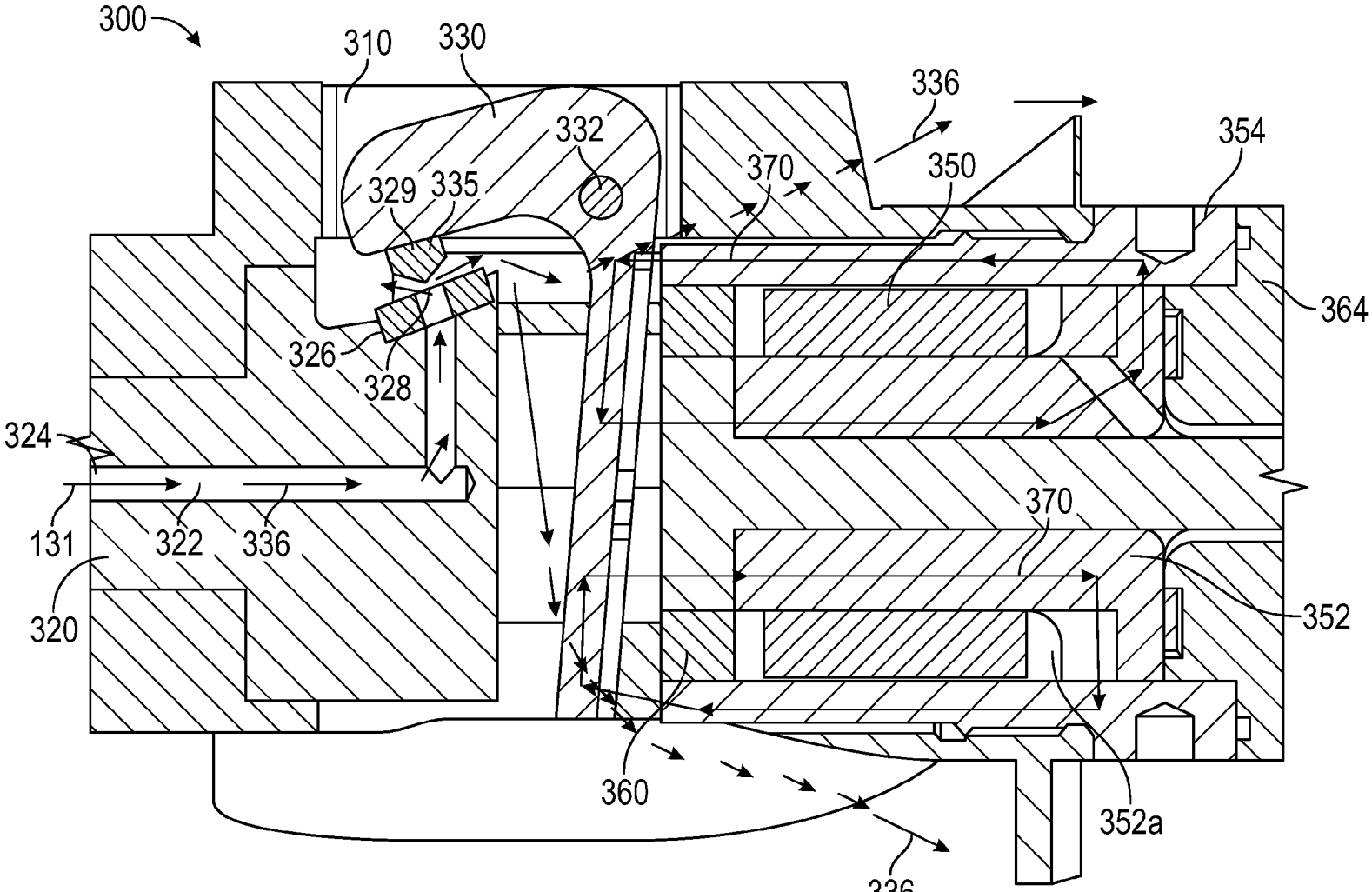
FIG. 3 shows a flow control device according to another embodiment of the disclosure that may be utilized in a system, such as system shown in FIG. 1.

FIG. 3 shows a flow control device or pulser 300 in an open position made according to another embodiment of the disclosure that may be utilized as a pulser in the drilling system 100 of FIG. 1 for generating pressure pulses down-hole or to perform another selected function. The device 300 includes a non-magnetic body 310 that houses a valve member 320 having a fluid flow path or passage 322 therein that includes an inlet 324 for receiving a fluid 308 and an outlet 326 for discharging the fluid 308 therethrough. The outlet 326 includes a valve seat 328 for accepting therein a plunger or poppet 329 for closing and opening of the fluid flow path 322. In one embodiment, the plunger 329 may be attached to a movable member 330 for moving the plunger 329 in and out of the valve seat 328, which movable member in one embodiment may be a lever 330 that rocks about a pivot 332. The lever 330 includes the closing member 329 at an end thereof, wherein the face 335 of the closing member 329 is shaped to sit or engage with inside the valve seat 328 to block or substantially block the flow of the fluid 131 through the passage 322. The flow of the fluid 131 through the device 300 when the flow passage 322 is open is shown by arrows 336.

Still referring to FIG. 3, the device 300 further includes a coil 350 disposed around a magnet 352. The coil 350 is supported on one end by the soft magnet or magnet end 352*a* and on the other end by a non-magnetic spacer 360. The magnet 352 may be placed around and supported on both sides by a magnetic member 364. Another magnet member 354 may be placed around the coil 350. Thus, in the particular embodiment of the device 300 of FIG. 3, magnets 352, and 354 and the lever 330 are made from suitable magnetic materials while the valve member 320, valve seat 328, plunger 329 and the spacer 360 are made from suitable non-magnetic materials. When the coil 350 is energized by the supply of a current therethrough, a magnetic circuit is formed from the magnet 354 to the lever 330 that returns to the magnet 354 via magnet 352 as shown by arrows 370. When the coil 350 is energized, the lever 330 rocks about the pivot 332 toward the valve seat 328, causing the plunger 329 to seat inside the valve seat 328 to block or substantially block the flow of the fluid 131 through the passage 322 and thus the device 300. Blocking of the fluid 131 through passage 322 causes a positive pressure in the fluid 131 flowing through the drill string 120 (FIG. 1). When the coil 350 is de-energized, the lever 330 moves away from the seat 328 due to the pressure applied by the fluid 131 on the plunger 329, allowing the fluid 131 to flow through the passage 322 and thus the device 300. Each de-energizing of the coil 350 opens the fluid passage 322, generating a negative pressure in the fluid 131 flowing through the drill string 120 (FIG. 1). As described in reference to FIG. 2, the flow rate through the passage 322 defines the amplitude of a pulse, the time between successive energizing and de-energizing of the coil 350 defines the length or duration of the pulse, the time between the de-energizing and energizing defines the time or duration between the pulses and the number of pulses over a selected time period defines the frequency of the pulses. The flow of the fluid 131 through the device 300 is shown by arrows 336.

Figure 4:
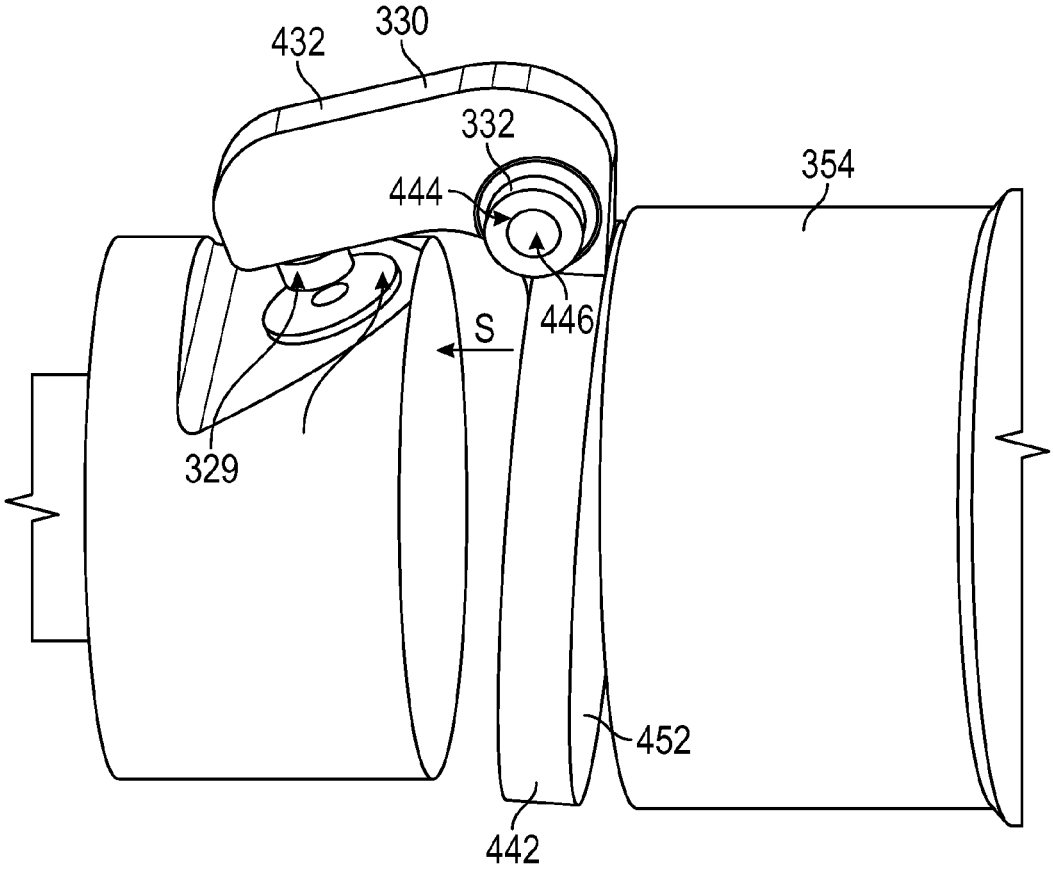
FIG. 4 shows a mechanism relating for operating a closing member for closing and opening the flow path of the flow control shown in FIG. 3.

FIG. 4 shows a valve mechanism relating to the operation of the lever 330 shown in FIG. 3, according to one embodiment of the disclosure. In one embodiment, the lever 330 may include a head member 432 and cylindrical member or pole plate 442, wherein the lever 330 rocks about a pivot 332. The pole plate 442 may include perforations 452 to prevent clogging of the fluid 131 flowing through the device 300 by debris or other particles in the fluid 131. In one embodiment, the pivot 332 may include a male bearing 444 and a female bearing 446. In the configurations of the flow control devices shown in FIGS. 3 and 4, the pole plate 442 moves in the space "S" between the valve member 320 and the shell 354. The movement of the plunger 329 is not transitional. The plunger 329 is fixed to the lever 330 that rotates about a selected axis. In this embodiment, the lever 330 is part of the magnetic circuit and may be made of a material having good magnetic properties, such as 9 Cr. Also, the plunger 329 and the valve seat 328 may be made from any material that does not influence the magnetic circuit 370. In the embodiments described hereinabove, the fluid in the gap of the magnet circuit is a drilling fluid when such devices are utilized in a drilling system.

Although the flow control device herein is described as a mud pulser for generating pressure pulses in a drilling assembly, the device may be utilized for any other suitable purpose or for performing any other function, including, but not limited to: control of mud hydraulic driven steering tools, expandable reamers and expandable stabilizers; setting of packers; operating sliding sleeves and production valves; control of additive dosing devices; and control and/or operation of devices at the surface.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to".

The invention claimed is:

1. An apparatus for use in a drilling assembly during drilling of a wellbore, comprising:

a flow control device that includes:

a fluid flow path having an inlet and an outlet; and an electromagnetic circuit that includes a closing member made from a magnetic material as a part of the electromagnetic circuit, wherein the closing member at least partially rotates about a selected axis to move from a first open position to a second closed position to close the fluid path to produce a pressure pulse in a fluid flowing through the fluid flow path when the electromagnetic circuit is formed, wherein the closing member includes a plunger at an end thereof and a pole plate at an opposite end thereof that is included in the electromagnetic circuit when the electromagnetic circuit is formed.

2. The apparatus of claim 1, wherein the electromagnetic circuit closes via a gap filled with a drilling fluid.

3. The apparatus of claim 1, wherein the closing member is immersed in a fluid.

4. The apparatus of claim 1 further comprising a coil between a first magnetic member and a second magnetic member and wherein when the coil is energized, the electromagnetic circuit is formed among the first magnetic member, the second magnetic member and the closing member to cause the closing member to move from the first open position to the second closed position.

5. The apparatus of claim 4, wherein the pole plate moves to rotate a lever about the selected axis when the electromagnetic circuit is formed.

6. The apparatus of claim 4, wherein the plunger is made from a hard material dimensioned to close the outlet of the fluid flow path when the electromagnetic circuit is formed.

7. The apparatus of claim 1, wherein the closing member remains in the first open position when a fluid under pressure is supplied to the fluid flow path and the coil is not energized due to the pressure applied by the fluid on the plunger.

8. The apparatus of claim 4, wherein the first magnetic member is enclosed by a non-magnetic body.

9. The apparatus of claim 5, wherein the pole plate has flow through paths to allow passage of solid particles below a selected size therethrough.

10. A method of producing pressure pulses in a drilling assembly during drilling of a wellbore, the method comprising:

conveying a drilling assembly in the wellbore, the drilling assembly including a flow control device that further includes:

a fluid flow path having an inlet and an outlet;

a coil between a first magnetic member and a second magnetic member; and a closing member made from a magnetic material, wherein the closing member includes a plunger at an end thereof and a pole plate at an opposite end thereof;

wherein when the coil is energized, an electromagnetic circuit is formed among the first magnetic member to rotate the closing member about a selected axis from a first open position to a second closed position to close the fluid path to produce a pressure pulse in a fluid flowing through the fluid flow path;

supplying the fluid to the flow control device; and selectively energizing the coil to form the electromagnetic circuit to rotate the closing member about the selected axis to the second closed position to generate a pressure pulse in the fluid flowing through the flow control device.

11. The method of claim 10, wherein the closing member is a lever that rotates about the selected axis when the electromagnetic circuit is formed.

12. The method of claim 10, wherein the plunger is made from a hard material dimensioned to close the outlet of the fluid flow path when the electromagnetic circuit is formed.

13. The method of claim 10, wherein the closing member remains in the first open position when the fluid under pressure is supplied to the fluid flow path and the coil is not energized due to the pressure applied by the fluid on the plunger.

14. The method of claim 10, wherein the first magnetic member is enclosed by a non-magnetic body.

15. The method of claim 11, wherein the pole plate has at least one flow through path to allow passage of solid particles below a selected size therethrough.

16. The method of claim 10, wherein the drilling assembly further includes a sensor that provides signals relating to a parameter of interest and a circuit that processes the signals to generate the parameter of interest, the method further comprising transmitting the generated parameter of interest as pressure pulses generated by fluid flow control device during drilling of the wellbore.

* * * * *